US006546562B2

(12) United States Patent
Cheng

(10) Patent No.: US 6,546,562 B2
(45) Date of Patent: Apr. 15, 2003

(54) ADJUSTABLE ENCIRCLING HEADBAND

(76) Inventor: Chen-An Cheng, No. 1-5, Alley 112, Lane 150, Section 2, Hon Tian Road, Tainan (TW)

( * ) Notice: Subject to any disclaimer, the term of this patent is extended or adjusted under 35 U.S.C. 154(b) by 0 days.

(21) Appl. No.: 09/900,900

(22) Filed: Jul. 10, 2001

(65) Prior Publication Data

US 2003/0019011 A1 Jan. 30, 2003

(51) Int. Cl.[7] ..... A42B 7/00
(52) U.S. Cl. ..... 2/171
(58) Field of Search ..... 2/171, 171.4, 181.6, 2/181.8, 182.3, 182.5, 182.6, 182.7, 183, 195.2, 195.4, DIG. 11, 338, 339; 24/31 F, 31 L, 173, 174, 190, 615; 132/275; 63/3

(56) References Cited

U.S. PATENT DOCUMENTS 2,138,542 A * 11/1938 Goldberg ..... 24/206
2,700,977 A * 2/1955 Neerup ..... 132/46
3,214,769 A * 11/1965 Randolph ..... 2/171
D213,972 S * 4/1969 Atwood ..... D30/4
4,481,681 A * 11/1984 Hankin ..... 2/197
5,427,562 A * 6/1995 Hwang ..... 450/58
5,464,136 A * 11/1995 Eddy ..... 224/252
5,697,107 A * 12/1997 Takimoto ..... 2/338
5,926,848 A * 7/1999 Bartholomae ..... 2/171
5,933,870 A * 8/1999 Egan, Jr. et al. ..... 2/209.13
5,946,728 A * 9/1999 Tane ..... 2/171
6,047,709 A * 4/2000 Tu ..... 132/275
6,269,488 B1 * 8/2001 Jurgensen et al. ..... 2/171
6,289,903 B1 * 9/2001 Haufler ..... 132/275
6,317,887 B1 * 11/2001 Gattamorta ..... 2/12
6,382,218 B1 * 5/2002 Cheng ..... 132/275

* cited by examiner

*Primary Examiner*—Gloria M. Hale
*Assistant Examiner*—Alissa L. Hoey
(74) *Attorney, Agent, or Firm*—Rosenberg, Klein & Lee

(57) ABSTRACT

An adjustable encircling headband is one piece item composed of several ornamental blocks. On one end of the encircling headband is provided with an inserting portion, and on the other end is provided with a receiving base. In the inserting portion are provided with a plurality of mounting holes in two opposite rows, and an inserting strip is provided on the front end of the inserting portion. An inserting ring is formed between the encircling headband and the inserting portion for the inserting strip to penetrate through. On the receiving base are provided with two flanges. The inserting strip is penetrated through the inserting ring, and the flanges are inlaid in one preferable pair of the mounting holes for the inserting portion to be secured to the receiving base so as to form an adjustable encircling headband.

1 Claim, 4 Drawing Sheets

ADJUSTABLE ENCIRCLING HEADBAND

BACKGROUND OF THE INVENTION

1. Field of the Invention

The present invention relates to an adjustable encircling headband whose diameter can be adjusted to fit over various sizes of forehead of different wearers, and more particularly to an encircling headband which is one piece item and can be spread out for restoration or package.

2. Description of the Related Art

An encircling headband, generally in shape of a crown, is generally worn by a performer for the role he/she acts on the stage, and it is also commonly worn by children for decoration. A conventional encircling headband is formed of one size, and it is always secured to the head of a wearer by clips. However, the conventional encircling headband can not fit over various sizes of forehead of different wearers because the sizes of the forehead of different wearers are not the same. Therefore, while being worn on the forehead, the conventional encircling headband will make a wearer feel too tight or too slack, and it causes much trouble for a wearer.

SUMMARY OF THE INVENTION

Accordingly, the present invention is directed to an adjustable encircling headband that can substantially obviate the drawback and promote the practical use of a conventional related encircling headband.

An object of the present invention is to provide an adjustable encircling headband whose diameter can be easily adjusted to fit over the size of a wearer's forehead so as for the wearer to feel comfortable.

Another object of the present invention is to provide an adjustable encircling headband which is one piece item and can be spread out for restoration or package.

Yet another object of the present invention is to provide an adjustable encircling headband which can allow partial hair of a wearer to be arranged out of the headband for aesthetic purpose.

To achieve these advantages, an adjustable encircling headband in the present invention is one piece item and composed of several ornamental blocks. On one end of the encircling headband is provided with an inserting portion, and on the other end is provided with a receiving base. In the inserting portion are provided with a plurality of mounting holes in two opposite rows, and an inserting strip is provided on the front end of the inserting portion. An inserting ring is formed between the encircling headband and the inserting portion for the inserting strip to penetrate through. On the receiving base are provided with two flanges in formation to register with each pair of the mounting holes in friction fit. While being assembled, the inserting strip is penetrated through the inserting ring, and then the flanges are inlaid in one preferable pair of the mounting holes for the inserting portion to be secured to the receiving base so as to form an adjustable encircling headband.

BRIEF DESCRIPTION OF THE DRAWINGS

Other features and advantages of the present invention will become apparent in the following detailed description of the preferred embodiments with reference to the accompanying drawings, in which.

DETAILED DESCRIPTION OF THE PREFERRED EMBODIMENTS

Figure 2:
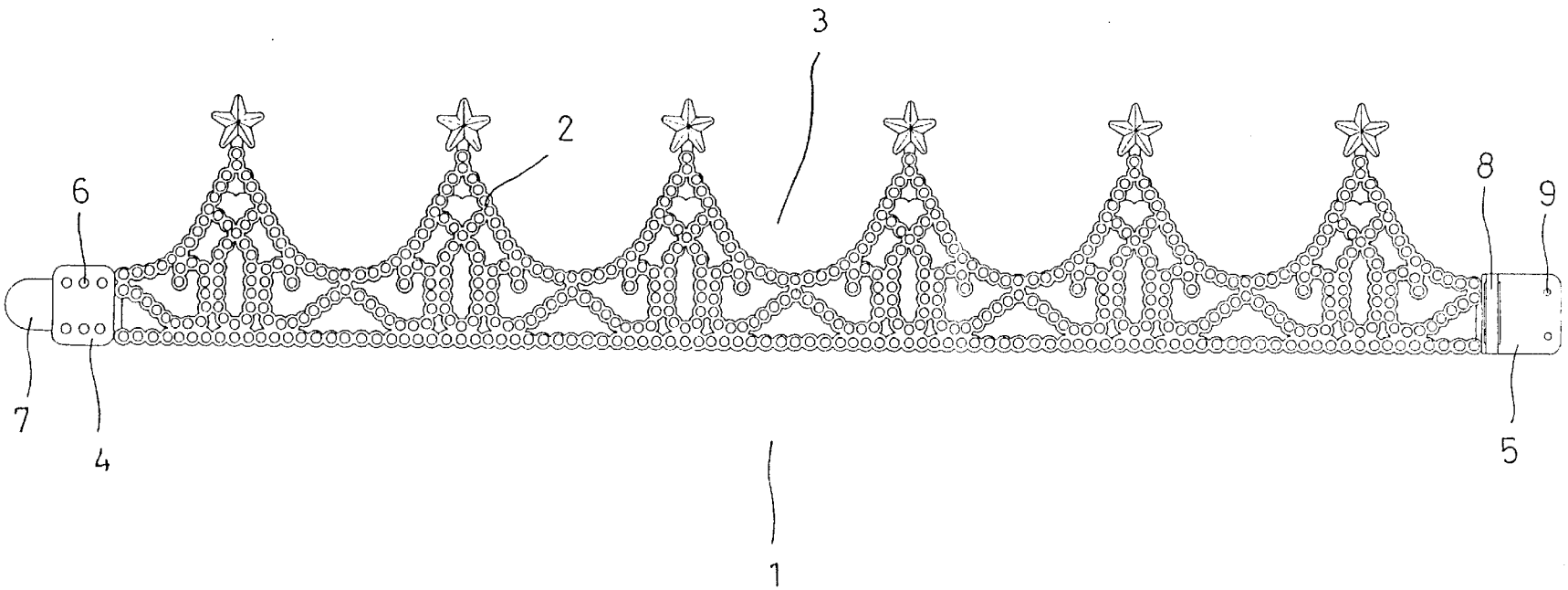
FIG. 2 is a spread front elevation view of the encircling headband in accordance with the present invention.

Referring to FIG. 2, a preferred embodiment of an adjustable encircling headband 1 in the present invention is one piece item and composed of several ornamental blocks 2. A space 3 is formed between two joined ornamental blocks 2. On one end of the encircling headband 1 is provided with an inserting portion 4, and on the other end is provided with a receiving base 5. In the inserting portion 4 are provided with a plurality of mounting holes 6 in two opposite rows, and an inserting strip 7 is provided on the front end of the inserting portion 4. An inserting ring 8 is formed between the encircling headband 1 and the inserting portion 4 for the inserting strip 7 to penetrate through. On the receiving base 5 are provided with two flanges 9 in formation to register with each pair of the mounting holes 6 in friction fit.

Figure 1:
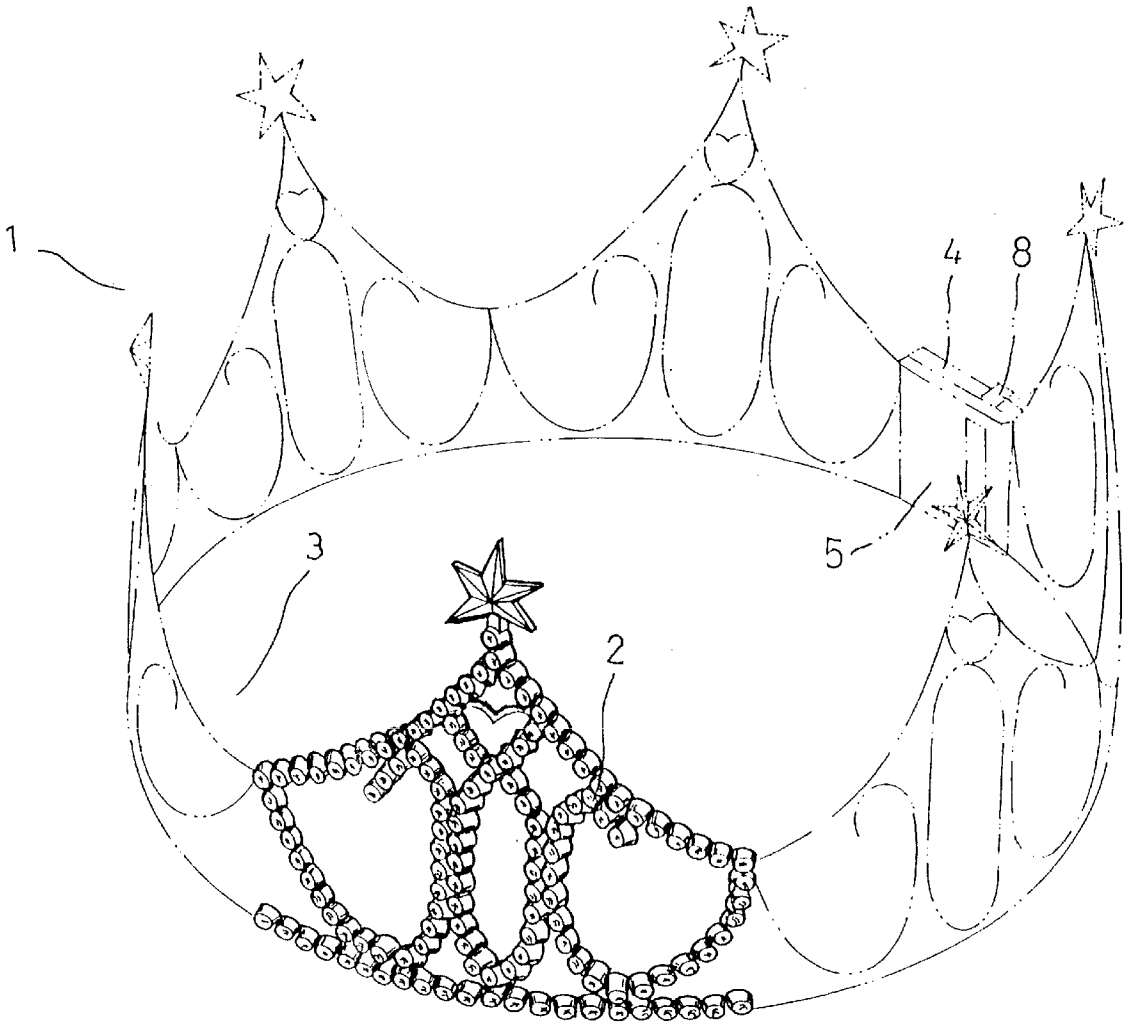
FIG. 1 is a perspective view of an embodiment of an encircling headband in assembled configuration in accordance with the present invention.
Figure 3:
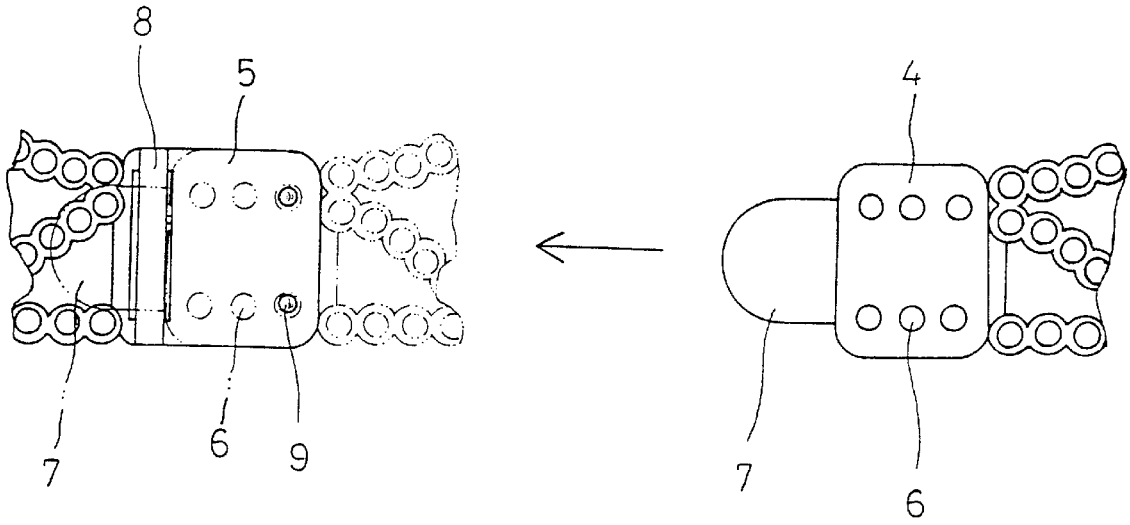
FIG. 3 is a schematic view of the inserting portion being secured to the receiving base in accordance with the present invention.
Figure 4:
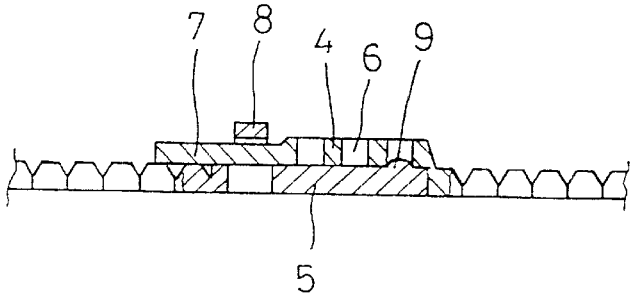
FIG. 4 is a sectional view of the inserting portion being assembled with the receiving base in accordance with the present invention; and, FIG. 5 is a perspective view showing the encircling headband in accordance with the present invention being worn on the head of a wearer.

While being assembled, referring to FIGS. 3 and 4, the inserting strip 7 is penetrated through the inserting ring 8, the receiving base 5 is on the rear of the inserting portion 4, and then the flanges 9 are inlaid in a preferable pair of the mounting holes 6 for the inserting portion 4 to be secured to the receiving base 5 so as to form an encircling headband 1, as shown in FIG. 1. By means of the flanges 9 being inlaid in different pairs of the mounting holes 6, the diameter of the encircling headband 1 can be easily adjusted to fit over the size of a wearer's forehead so as for the wearer to feel comfortable.

Figure 5:
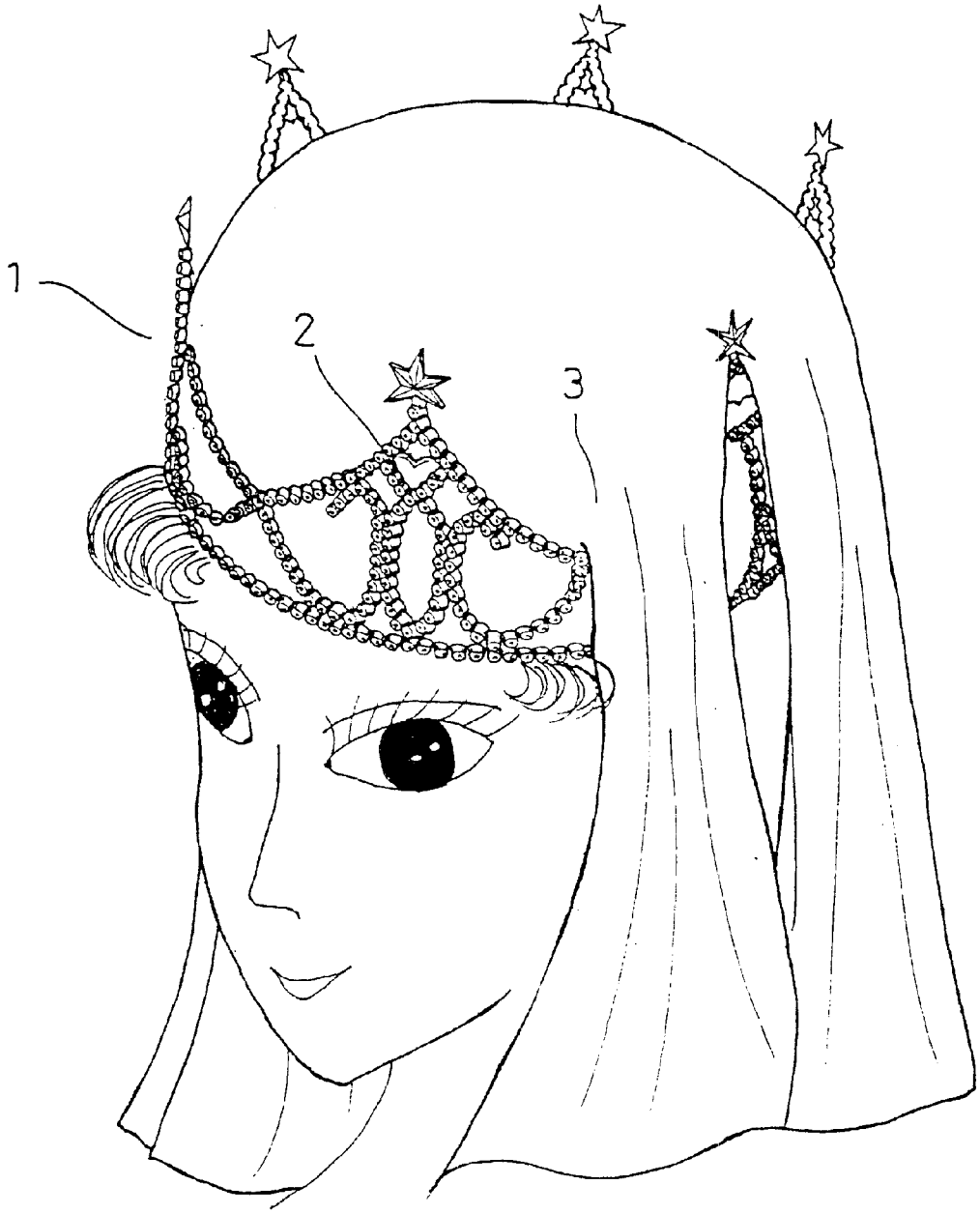

Furthermore, the adjustable encircling headband 1 can allow partial hair of a wearer to be arranged out of the headband 1 for aesthetic purpose, as shown in FIG. 5.

While the preferred embodiments of the invention have been described above, it will be recognized and understood that various modifications may be made thereto and the appended claims are intended to cover all such modifications which may fall within the spirit and scope of the invention.

What is claimed is:

1. An adjustable encircling headband, comprising:

a plurality of ornamental blocks integrally connected each to the other and thus forming a headband having first and second opposite ends thereof;

an inserting portion positioned at said first end of said headband, said inserting portion including a plurality of mounting holes formed thereon and arranged in pairs of aligned said mounting holes, an inserting strip extending from a front end of said inserting portion;

a receiving base positioned at said second end of said headband, said receiving base including two flanges extending therefrom and positioned in alignment with each of said pairs of said mounting holes, said two flanges of said receiving base engaging into a respective one of said pairs of said mounting holes of said inserting portion, thereby securing said receiving base to said inserting portion in a predetermined relative disposition therebetween by a frictional engagement between said two flanges and said respective pair of said mounting holes, by engaging said two flanges in said respective pairs of said mounting holes, the distance between said first and second ends of said headband being adjusted to comply with a wearer's head size; and an inserting ring positioned between said second end of said headband and said receiving base to receive said inserting strip therein.

* * * * *